United States Patent [19]

Zabotin et al.

[11] 4,076,051

[45] Feb. 28, 1978

[54] APPARATUS FOR CHARGING WEFT THREAD CARRIERS

[76] Inventors: Alexandr Alexandrovich Zabotin, Belayaevo-Borgorodskoe, kvartal 45, korpus 26, kv. 85, Moscow; Evgeny Dmitrievich Loschilin, Domodedovo, ulitsa 8 Marta, 34a, Moskovskaya oblast, Domodedovo; Eduard Arshakovich Onikov, ulitsa Panferova, 5, korpus 2, kv. 106; Alexandr Lvovich Galperin, ulitsa Moldagulovoi, 10, korpus 3, kv. 166, both of Moscow, all of U.S.S.R.; Nicola Santucci, Schio (Vicenza), 32; Luciano Corain, Vicenza, both of Italy

[21] Appl. No.: 724,763

[22] Filed: Sep. 20, 1976

[30] Foreign Application Priority Data

Sep. 23, 1975 U.S.S.R. ..... 2170554

[51] Int. Cl.[2] ..... D03D 47/26

[52] U.S. Cl. ..... 139/436; 242/47

[58] Field of Search ..... 139/436, 224 R, 224 A; 242/47

[56] References Cited

U.S. PATENT DOCUMENTS

| | | | |
|---|---|---|---|
| 3,732,896 | 5/1973 | Jekl et al. | 139/436 |
| 3,835,893 | 9/1974 | Galperin et al. | 139/436 |
| 3,976,105 | 8/1976 | Steiner | 139/436 |

*Primary Examiner*—Henry S. Jaudon

*Attorney, Agent, or Firm*—Steinberg & Blake

[57] ABSTRACT

The invention relates to apparatus for charging weft thread carriers in wave-type shedding looms. The apparatus comprises a thread guide including a rod having an opening made in one end thereof for the passage of a thread, the other end being pivotally connected with a drive and said rod is mounted in a support disposed intermediate the ends of the rod and arranged so that during a charging operation the ends of the rod are driven through circular motions. The apparatus reduces the thread charging time and also reduces the thread breakage rate, owing to less mechanical action upon the thread.

8 Claims, 1 Drawing Figure

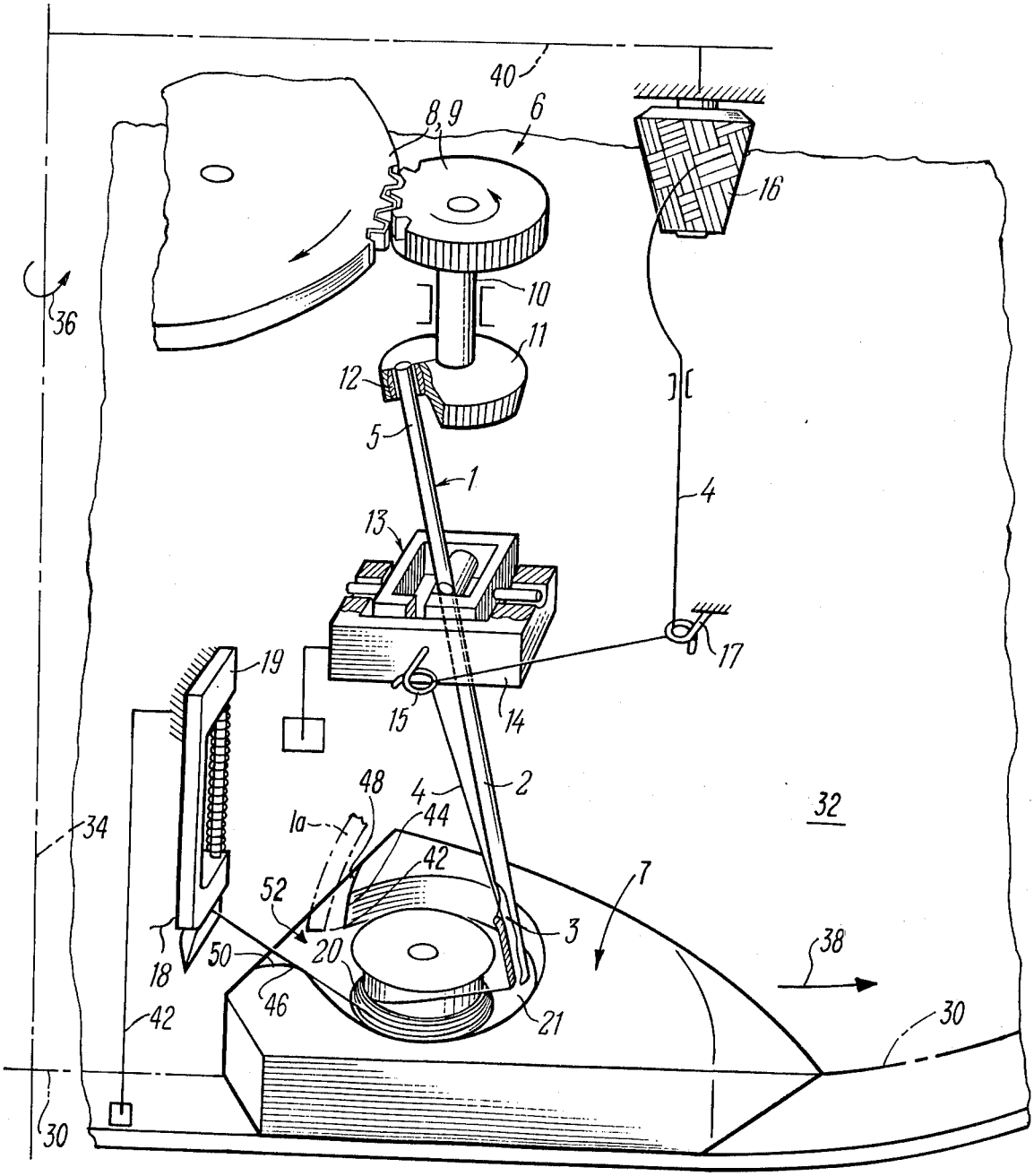
40
8,9
6
16
36
10
11
12
5
1
4
13
17
19
15
14
48
4
2
32
34
1a
44
42
7
52
3
38
50
20
18
46
21
30
42
30

APPARATUS FOR CHARGING WEFT THREAD CARRIERS

The invention relates to weaving looms and, more particularly it relates to apparatus for charging weft thread carriers, incorporated in looms.

The invention can be utilized to utmost effectiveness in wave-type shedding looms, i.e. in looms where simultaneously a plurality of sheds is formed, with each shed thus formed accommodating therein a moving weft thread carrier.

There is a known apparatus for charging weft thread carriers, including a thread guide made in the form of a hollow member which is generally wing-shaped. One end of the threaded guide has made therein an opening for the passage of a thread, the other end of the guide being associated with a drive imparting to the hollow member a circular motion in a plane parallel with the plane of the motion of the weft thread carriers (see, for example, the West German Pat. No. 2,120,309, Int. Cl. D 01 C). In this apparatus the weft thread unwound from a bobbin passes through the hollow member and is guided thereby onto the spool of a weft thread carrier. Owing to the rotation of the hollow member, the thread is wound onto the spool of the weft thread carrier.

In the hitherto known apparatus of the above described type in case of thread breakage it takes a considerable amount of time to re-thread the thread throught the hollow member. Otherwise, it is necessary to incorporate some additional devices to spped up the operation of inserting or threading-in the thread. Such additional devices complicate the overall structure of the apparatus and make maintenance more difficult. Besides, the internal walls of the hollow member eventually becomes polluted, whereby additional mechanical action is exerted upon the thread. This, in its turn, results in more frequent thread breakage, which requires additional time for making the situation good, which, as has been already mentioned more often than not amounts to considerable periods of time. In this way the productivity of the loom is affected.

It is an object of the present invention to eliminate the above-mentioned disadvantages.

It is an object of the present invention to provide an apparatus for charging weft thread carriers, wherein the thread guide is of a structure providing for reducing considerably the thread re-threading time in case of thread breakage.

It is another important object of the present invention to provide an apparatus wherein the thread guide is of a structure providing for a reduced rate of thread breakage, owing to less mechanical action exerted upon the thread.

Still another object of the present invention is to provide an apparatus for charging weft thread carriers which steps up the productivity of the loom.

These and other objects are attained in an apparatus for charging weft thread carriers, of which the thead guide has an opening made in one end thereof for the passage of a thread, the other end of the thread guide being associated with a drive adapted to impart thereto motions in a plane parallel with the plane of the motion of the weft thread carriers, in which apparatus, in accordance with the invention, the thread guide includes a rod having one end thereof provided with an opening for the passage of the thread, the opposite end of the rod being pivotally connected to the drive, the rod being mounted in a bearing support disposed intermediate these ends of the rod and so arranged that during a weft thread carrier charging operation the ends of the rod are driven through circular motions. This design reduces the amount of time required for re-threading the thread in case of thread breakage, since the thread passes through the opening of the weft thread carrier without engaging the walls thereof. Besides, the thread passes generally outside the thread guide, which prevents pollution of the latter. This, in its turn, reduces the amount of mechanical action exerted upon the thread, and, hence, considerably reduces the thread breakage rate.

In accordance with the present invention, the said support comprises a gimbal joint.

The stationary part of the gimbal joint carries thereon an eyelet member adapted to guide the thread during a weft thread carrier charging operation.

For the present invention to be better understood, given hereinbelow is a description of an embodiment thereof, with reference being had to the accompanying drawing which shows a perspective view of an apparatus for charging weft thread carriers, in accordance with the invention.

Throughout the cloth-weaving operation the carriers 7, one of which is schematically illustrated, insert the weft thead through the shed. The carriers 7 are transported and guided in a well known manner by way of a structure which includes an endless chain 30, schematically indicated, this chain 30 transporting the carriers 7, which are suitably spaced from each other, after they travel through the shed, to a rotary, horizontal table assembly 32, which is well known and schematically indicated in a fragmentary manner, this table 32 being rotated by the chain 30 about its central axis 34 which coincides with the axis of a central vertical rotary shaft which rotates with the table assembly 32 in the direction of the arrow 36, the carriers 7 each moving in the direction of the arrow 38 with the rotary, circular table assembly 32 along approximately the outer half of the periphery thereof at one end region of the path of movement of the chain 30, as is well known. Thus, a number of carriers 7 will at any given moment during operation of the loom be travelling together with the table 32 in the manner indicated for one of the carriers 7 in the drawing, and the structure shown in the drawing and described below for charging the carrier 7 with a supply of weft thread is duplicated for each of the carriers as they travel together with the rotary table assembly 32. Following the weft-insertion stage, the carriers enter the charging zone where they are charged with a supply of the weft thread by the herein disclosed apparatus. The apparatus comprises a thread guide made in the form of a rod 1 of which one end 2 has made therein an opening 3 for the passage of the weft thread 4. The other end 5 of the rod 1 is operatively connected to a drive or drive means 6 operatively connected to each rod 1 to impart to the ends of the rod 1 circular motions so that the opposed ends of rod 1 describe circles situated in respective planes parallel with the plane of the progress of the weft thread carriers 7. The drive 6 includes pinions 8 and 9, the pinion 8 being a positively driven one, and the pinion 9 being mounted on a shaft 10 carrying a crank 11. The pinion 8 of each drive means 6 may be positively driven in the direction indicated by the arrow for example by way of a suitable transmission from a stationary gear which surrounds the axis 34, so that the pinion 8 is driven in response to rotation of the table assembly 32 about the axis 34. The last-mentioned crank 11 is operatively pivotally connected by means of a spherical bearing 12 with the end 5 of the rod 1. A bearing support 13 for the rod 1 is disposed intermediate the ends 2 and 5 thereof, the support being in the form of a gimbal joint. Thus, the bearing support 13 forms a support means carried by the table assembly 32 for rotation therewith, as schematically indicated, and supporting the rod 1, intermediate the ends thereof, the tilting movement in all directions Owing to the incorporation of the gimbal joint 13 as the support, with the drive 6 operating, the rod 1 is immobile with respect of its own axis, while its ends 2 and 5 are driven through circular motions. The stationary member 14 of the gimbal joint 13 supports thereon an eyelet member 15 adapted to guide the weft thread 4.

The weft thread 4 is unwound from a bobbin 16, whereafter it is threaded to pass through another eyelet member 17, then through the eyelet member 15 and then through the opening 3. Each of the bobbins 16 is supported in a well known manner, as schematically indicated in the drawing, from a horizontal arm 40 fixed to and extending radially from the rotary central shaft which turns with the table assembly 32 about the axis 34 in the direction of the arrow 36. The free end 18 of the weft thread 4 is retained through the winding operation by a clamp 19. Each clamp 19 is supported by a suitable known structure 42, schematically indicated in he drawing, adjacent the outer periphery of the rotary table assembly 32, so that the several clamps 19 rotate together with the table assembly 32. The thread carrier 7 has a spool 20 onto which the thread 4 can be wound by the action of the thread guide rod 1. The spool 20 is received in a notch 21 provided in the carrier 7, the dimensions of the notch 21 being such that the end 2 of the rod 1 can be radially accommodated for free rotation about the spool 20.

Thus, the apparatus operates, as follows.

The thread guide rod 1 is actuated by the driven pinion 6, the free end 18 of the weft thread 4 being gripped and held by the clamp 19. The weft thread 4, pre-threaded through the easy-to-thread eyelet members 17 and 15, is unwound from the supply package 16 by the action of the thread guide rod 1 and is wound in successive coils onto the spool 20 of the weft thread carrier 7, which spool is meanwhile stationary.

The thread threaded through the outlet opening 3 of the thread guide rod 1 by-passes the driving zone of the apparatus, which both cuts down the threading time and reduces the rate of thread breakage. In the course of a spool-winding operation the thread rod guide 1 is driven through a predetermined number of revolutions, depending on the length of the thread to be wound. Following the winding stage, the guide rod 1 is arrested in a position suitable for its exit from the notch 21 of the carrier 7.

As was indicated above, each carrier 7 is provided with a charge of weft thread 4 during travel of each carrier 7 with the rotary table assembly 32 along approximately the outer half of the periphery thereof, the drive connected to the pinion 8 being effective only during travel of each weft thread carrier 7 along this outer half of the periphery of the rotary table assembly 32. When the winding of the coils of thread on the spool 20 have terminated, the rod 1 is in the inclined position 1a schematically indicated in the drawing, substantially diametrically opposed fom the position of the rod 1 which is shown in solid lines in the drawing. The notch 21 has an opening 42 defined between edges 44 and 46 of the carrier 7, and from these edges 44 and 46 the carrier 7 has wall portions 48 and 50 which diverge from each other so as to define between themselves a flaring or tapered entrance and exit region 52 for the rod 1. As each carrier 7 is transported tangentially to become initially located along a part of the periphery of the rotary table assembly 32, the rod 1 turning with the tabel 32 and arrested with respect thereto in the position 1a turns behind the carrier 7 and becomes situated at the region 52 thereof in the position **1*a* indicated in the drawing. Then as the carrier 7 continues to turn with the table 32 along the outer peripheral region thereof, the drive means 6 drives the rod 1 in the manner described above so as to provide the coils of weft thread on the spool 20, the weft thread being clamped by the clamp 19** at this time.

After the carrier 7 has turned through approximately 180° with the rotary table assembly 32, the spool-winding operation is completed and the rod 1 again is arrested in the position **1*a*, with each carrier 7 now moving tangentially beyond the rotary table assembly 32 to the clothweaving zone. This transporting of each carrier 7 beyond the table 32 in the well known manner to the weaving zone results in pulling of the thread wound on the spool 20 from the clamp 19. However, the clamp 19 continues to turn with the table assembly 32, and of course the rod 1 also continues to turn with the table 32. As a result weft thread 4 continues to be drawn at this time from the bobbin 7 through the guies 17 and 15 and through the opening 3 of the rod 1 while the latter moves away from the carrier 7 which approaches the weaving zone while travelling toward the selvage of the woven fabric. Thus a part of the weft thread at this time extends from the spool 20 through the opening 42 of the notch 21 and beyond the zone 52 of the carrier 7 along a straight line. The clamp 19 which turns with the rotary table asembly 32 crosses this straight line along which the thread 4 extends so as to again clamp the thread extending beyond the opening 3 of the rod 1, and immediately thereafter a cutting mechanism which is in itself known and which is situated at the side of the loom adjacent the selvage of th woven thread cute the thread so as to provide the free end 18 projecting from the clamp 19 at the side thereof opposite from the rod 1. Thus, when the rod 1 again moves to the zone 52 of a shuttle 7 which is transported tangentially to the rotary table assembly 32**, the parts are in a position for repeating the above operations.

What is claimed is:

1. An apparatus for charging weft thead carriers in wave-type shedding looms, comprising: a thread guide including a rod; one end of said rod having made therein an opening for the passage therethrough of a weft thread; an opposite end of said rod; a drive adapted to impart motion to said rod, pivotally connected to said opposite end of said rod; a bearing support having said rod mounted therein, said bearing support being disposed intermediate of said ends of said rod and being so arranged that upon actuation of said drive said ends of said rod are driven through circular motions in respective planes parallel with the plane of the motion of the weft thread carriers, whereby the thread is introduced into the carrier for charging same.

2. An apparatus as claimed in claim 1, wherein said bearing suppot comprises a gimbal joint.

3. An apparatus as claimed in claim 2, wherein the stationary member of the gimbal joint carries thereon an eyelet member adapted to guide the thead during the thead carrier charging operation.

4. In an apparatus for charging, in wave-type shedding looms, weft thead carriers which move in a given plane during the charging thereof, an elongated rod having opposed ends one of which is formed with an opening through which weft thread is adapted to pass, support means supporting said rod for tilting movement in all directions, and drive means operatively connected to said rod for describing at least at said one end thereof a circle situated in a plane parallel to said given plane, while said rod tilts with respect to said support means, whereby thread issuing from said opening at said one end of said rod can be introduced into a carrier for charging the same.

5. The combination of claim 4 and wherein said one end of said rod is situated at an elevation lower than said support means.

6. The combination of claim 5 and wherein said support means is operatively connected to said rod intermediate the opposed ends thereof, so that said rod has distant from said one end thereof another end situated at an elevation higher than said support means.

7. The combination of claim 6 and wherein said drive means is operatively connected with said rod for describing circles at both of said opposed ends of said rod which are situated in planes parallel to said given plane.

8. The combination of claim 7 and wherein said drive means is operatively connected to said rod at said other end thereof.

* * * * *